US007033304B2

(12) United States Patent
Chuang et al.

(10) Patent No.: US 7,033,304 B2
(45) Date of Patent: Apr. 25, 2006

(54) ACTUATING DEVICE OF WRIST EXERCISER

(76) Inventors: Yun Yu Chuang, 4F, No. 16, Alley 15, Lane 82, Da Yong Street, San Chong City, Taipei (TW); Ming Hung Lin, 2F, No. 24, Lane 178, Li Shyng Road, Section 1, San Chong City, Taipei (TW); Pei Sung Chuang, No. 20, Alley 13, Lane 122, Tzu-Chiang Road, Dan Shui Town, Taipei (TW)

( * ) Notice: Subject to any disclaimer, the term of this patent is extended or adjusted under 35 U.S.C. 154(b) by 473 days.

(21) Appl. No.: 10/255,596

(22) Filed: Sep. 27, 2002

(65) Prior Publication Data

US 2004/0063546 A1 Apr. 1, 2004

(51) Int. Cl.
*A63B 23/14* (2006.01)
*A63B 43/06* (2006.01)

(52) U.S. Cl. ..... 482/45; 473/570

(58) Field of Classification Search ..... 482/44–50; 446/233–235, 256–264; 473/569–570, 575–576, 473/594–595

See application file for complete search history.

(56) References Cited

U.S. PATENT DOCUMENTS

| | | | | |
|---|---|---|---|---|
| 755,446 | A * | 3/1904 | Butcher | 446/233 |
| 3,932,957 | A * | 1/1976 | Morrison et al. | 446/234 |
| 5,353,655 | A * | 10/1994 | Mishler | 74/5 R |
| 6,083,076 | A * | 7/2000 | Saint-Victor | 446/242 |
| 6,186,914 | B1 * | 2/2001 | Lin | 473/594 |
| 6,607,420 | B1 * | 8/2003 | Chung | 446/235 |
| 6,666,743 | B1 * | 12/2003 | Polare et al. | 446/256 |

* cited by examiner

*Primary Examiner*—Stephen K. Cronin
*Assistant Examiner*—Fenn C. Mathew
(74) *Attorney, Agent, or Firm*—Rosenberg, Klein & Lee

(57) ABSTRACT

A wrist exercise includes a casing rotatably receiving a rotor therein. The casing defines slots that are aligned in pair. The rotor has axially aligned rotation shafts respectively and rotatably received in holes defined in the casing for rotatably supporting the rotor inside the casing. A drive roller is mounted to one of the rotation shafts. A drive bar is partially and movable received in the casing through the aligned slots to drivingly engage the drive roller whereby by forcibly pulling the drive bar out of the casing, the drive roller is caused to drive an initial rotation of the rotor with a high rotational speed.

9 Claims, 8 Drawing Sheets

ACTUATING DEVICE OF WRIST EXERCISER

BACKGROUND OF THE INVENTION

1. Field of the Invention

The present invention generally relates to a wrist exerciser, and in particular to the initial actuation of the wrist exerciser.

2. The Related Art

Wrist exercisers comprising a hollow casing inside which a spherical rotor is rotatably supported are known for exercising wrist-related muscles and for rehabilitation purposes. An example of the wrist exerciser is shown in U.S. Pat. No. 5,800,311. The operation of the wrist exerciser starts with actuating and driving the rotor to have the rotor rotating in high speed with great torque. A player that plays the wrist exerciser then uses his or her wrist and palm muscles to maintain the rotation of the rotor. This exercises the palm and wrist muscles of the player. In this respect, the initial actuation of the rotor is of importance.

FIG. 10 of the attached drawings shows a conventional wrist exerciser, generally designated with reference numeral A. The wrist exerciser A comprises a spherical rotor A1 rotatably mounted inside a spherical, hollow casing comprised of an upper hemi-spherical casing member A2 and a lower hemi-spherical casing member A3 mating each other. A circumferential groove A11 is defined in an outer surface of the rotor A1 and substantially extends along a great circle of the sphere of the rotor A1. A radially extending hole A12 is defined in the groove A11. A circular opening A21 is defined in the upper casing member A2 for the extension of a rope B therethrough. An end of the rope B that extends into the casing through the opening A21 is put into the hole A21 of the rotor A1. The rope B is then partially wrapped around the rotor A1 within the groove A11. Pulling the rope B off the rotor A1 through the opening A21 of the upper casing member A2 causes an initial rotation of the rotor A1.

Since the opening A21 is small compared to the player's hand, it is difficult to wrap the rope B around the rotor A1 in a very tight manner. Thus, when the rope B is quickly pulled off the rotor A1, the force that pulls the rope B off the rotor A1 may cause deviation of the rope B from the desired moving direction and thus leading to lose of control of the rotor A1 and failure of initial rotation.

In addition, since there must be an opening A21 defined in the casing for the extension of the rope B, surface integration of the spherical casing cannot be maintained, causing undesired adverse effect on the playing of the wrist exerciser A. The opening A21 may cause potential risks to the player's finger if the player accidentally puts his or he finger into the casing through the opening A21 and hit by the rotor A1 that is rotating in high speed.

Thus, it is desired to have a wrist exerciser having an actuating device for overcoming the above problems.

SUMMARY OF THE INVENTION

An object of the present invention is to provide a wrist exerciser having an actuating device that can be readily operated with no failure in initially starting the wrist exerciser.

Another object of the present invention is to provide a wrist exerciser comprising a casing having no large opening for the extension of a driving rope whereby damage caused by accidentally placing a finger into the casing by the player can be effectively eliminated.

A further object of the present invention is to provide a wriest exerciser comprising an actuating device that requires no large opening defined in a casing of the wrist exerciser for retaining the surface integration of the casing.

To achieve the above objects, in accordance with the present invention, there is provided a wrist exercise comprising a casing rotatably receiving a rotor therein. The casing defines slots that are aligned in pair. The rotor has axially aligned rotation shafts respectively and rotatably received in holes defined in the casing for rotatably supporting the rotor inside the casing. A drive roller is mounted to one of the rotation shafts. A drive bar is partially and movable received in the casing through the aligned slots to drivingly engage the drive roller whereby by forcibly pulling the drive bar out of the casing, the drive roller is caused to drive an initial rotation of the rotor with a high rotational speed.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENTS

Figure 1:
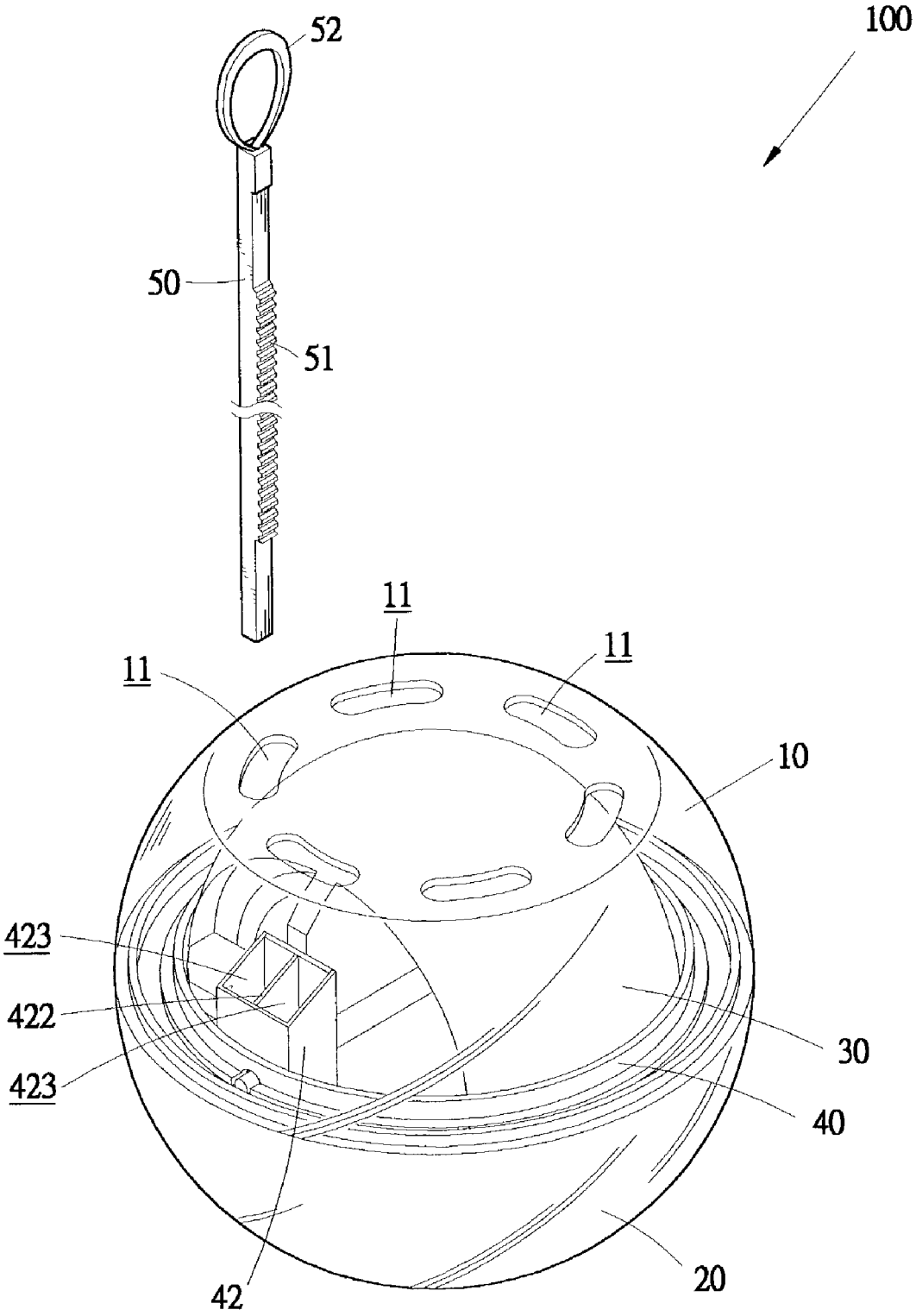
FIG. 1 is a perspective view of a wrist exerciser constructed in accordance with a first embodiment of the present invention.
Figure 2:
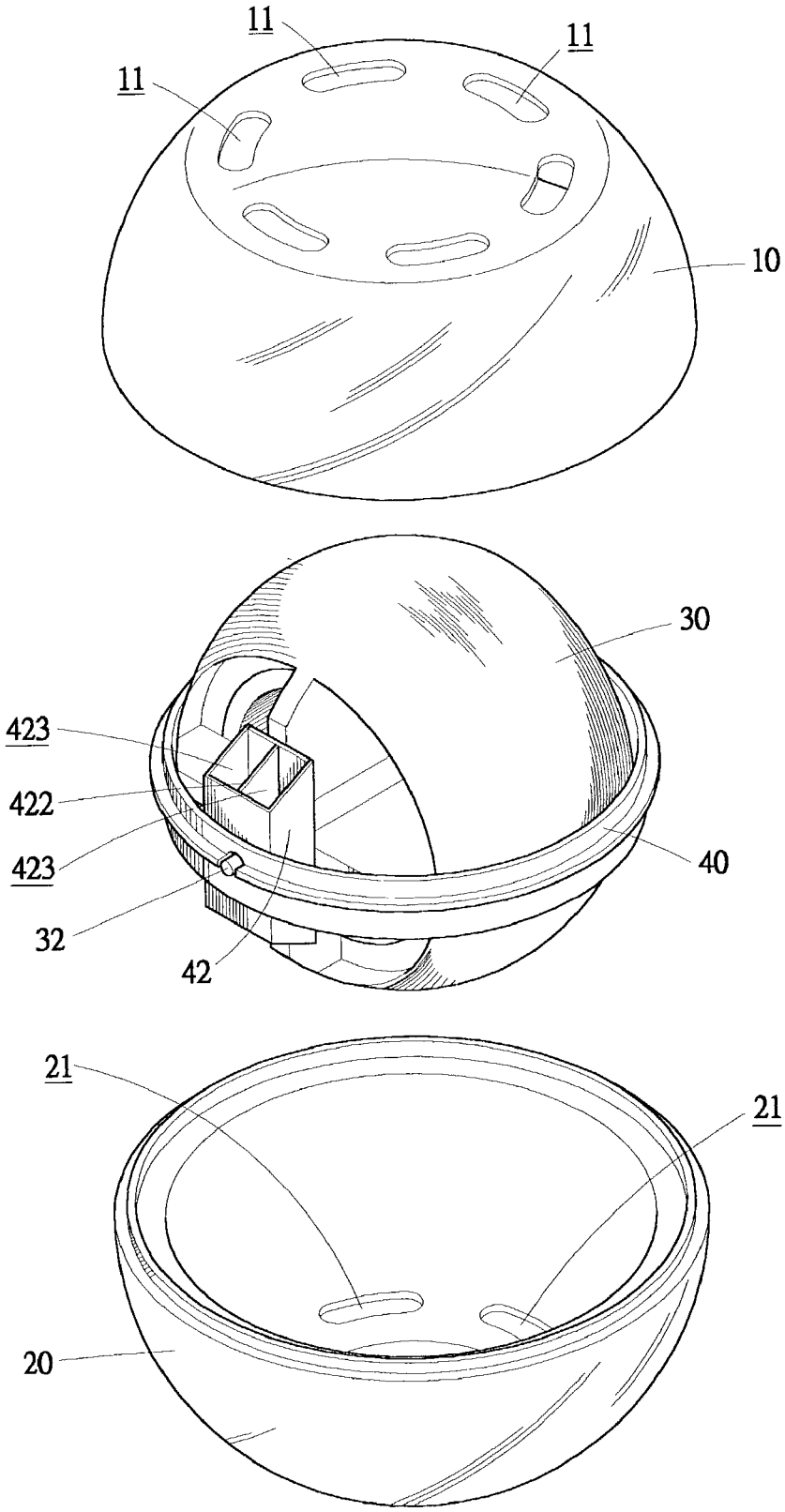
FIG. 2 is an exploded view of the wrist exerciser of the present invention.

With reference to the drawings and in particular to FIGS. 1–4, a wrist exerciser constructed in accordance with the present invention, generally designated with reference numeral 100, comprises a casing having a substantially spherical shape and comprising upper and lower casing members 10, 20 mating each other to define an interior space (not labeled) therebetween. If desired, the upper and lower casing members 10, 20 may be movable relative to each other A spherical rotor 30 is rotatably supported and received in the interior space. Slots 11, 12, preferably elongated in a circumferential direction, are defined in the upper and lower casing members 10, 20 and substantially aligned with each other.

Figure 3:
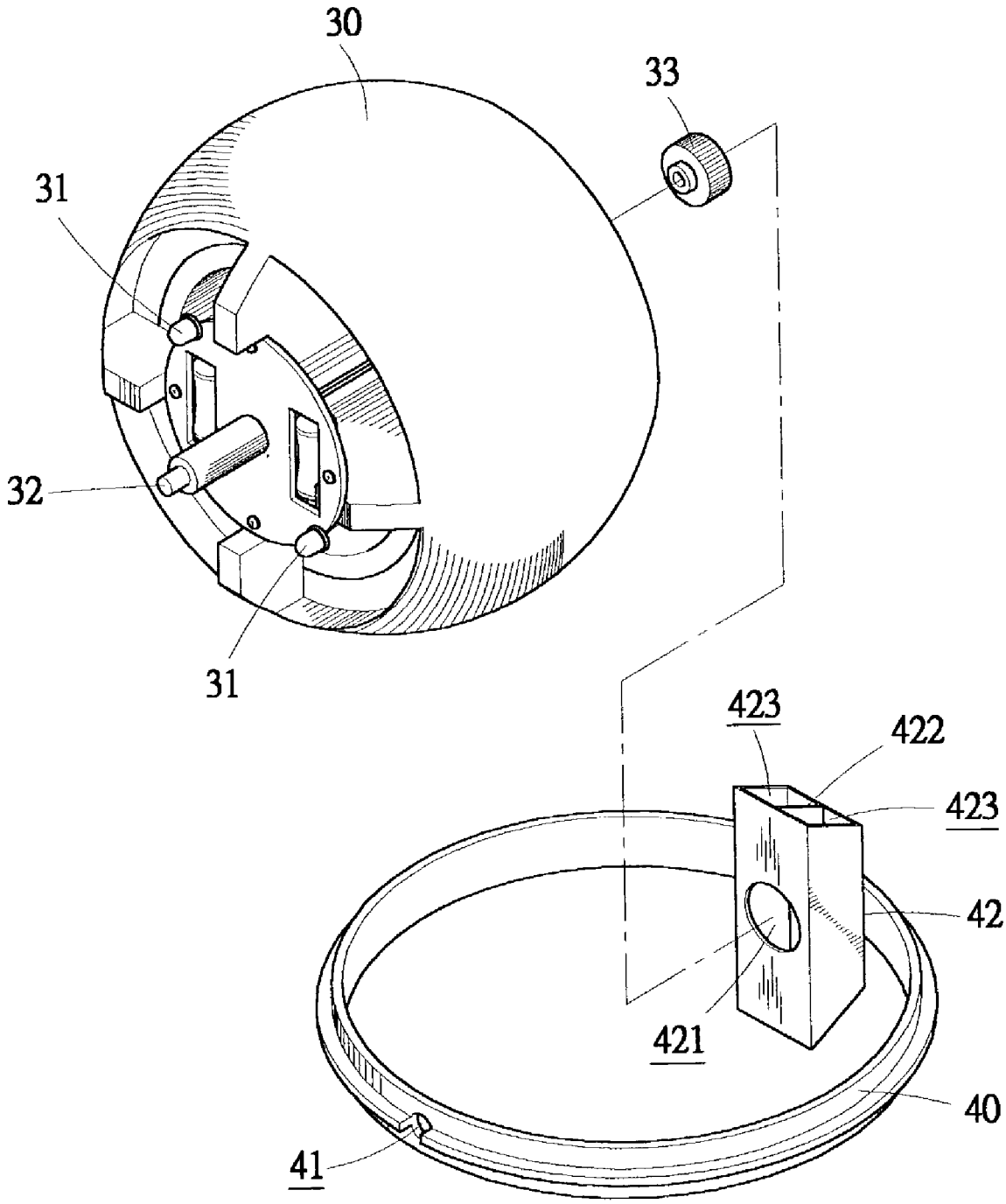
FIG. 3 is a perspective view of a rotor and a support ring that are movably mounted inside a casing of the wrist exerciser of the present invention.
Figure 5:
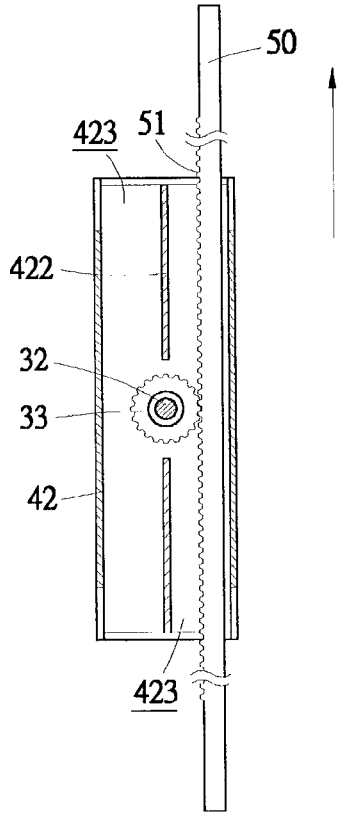
FIG. 5 is a cross-sectional view of an actuating device of the wrist exerciser of the present invention.

A support ring 40 is mounted between the upper and lower casing members 10, 20 and defines diametrically opposite holes 41. The rotor 30 comprises a substantially spherical body having axially aligned rotation shafts 32 on opposite sides thereof for being rotatably received in the holes 41 of the support ring 40 whereby the rotor 30 is rotatably supported by the support ring 40 within the interior space of the casing. A drive roller 33, constituting partly an actuating device of the wrist exerciser 10, is mounted to one of the rotation shafts 32. The roller 33 may have any desired form, such as a toothed wheel as shown in FIGS. 3 and 5. This will be further described.

If desired, light emitting elements 31, such as light emitting diodes, may be mounted to a circuit board attached to the rotor 30. When the rotor 30 rotates, the light emitting elements 31 are energized and give off light.

The actuating device of the wrist exerciser further comprises a box 42 mounted to the support ring 40 at a position corresponding to the drive roller 33 of the rotor 30 and substantially aligned with the slots 11, 21 defined in the upper and lower casing members 10, 20. The box 42 defines a channel (not labeled) extending in a direction substantially normal to the support ring 40. A partition 422 is mounted inside the channel of the box 42 to divide the channel into two separated passages 423. The partition 422 may comprise a single board or alternatively, the partition 422 is comprised of two separated but aligned boards.

The box 42 defines, in an inner side wall thereof, an opening 421 large enough to accommodate the drive roller 33 as well as the rotation shaft 32. Thus, the drive roller 33 is located inside the box 42 and between the two passages 423 as shown in FIG. 5.

Figure 4:
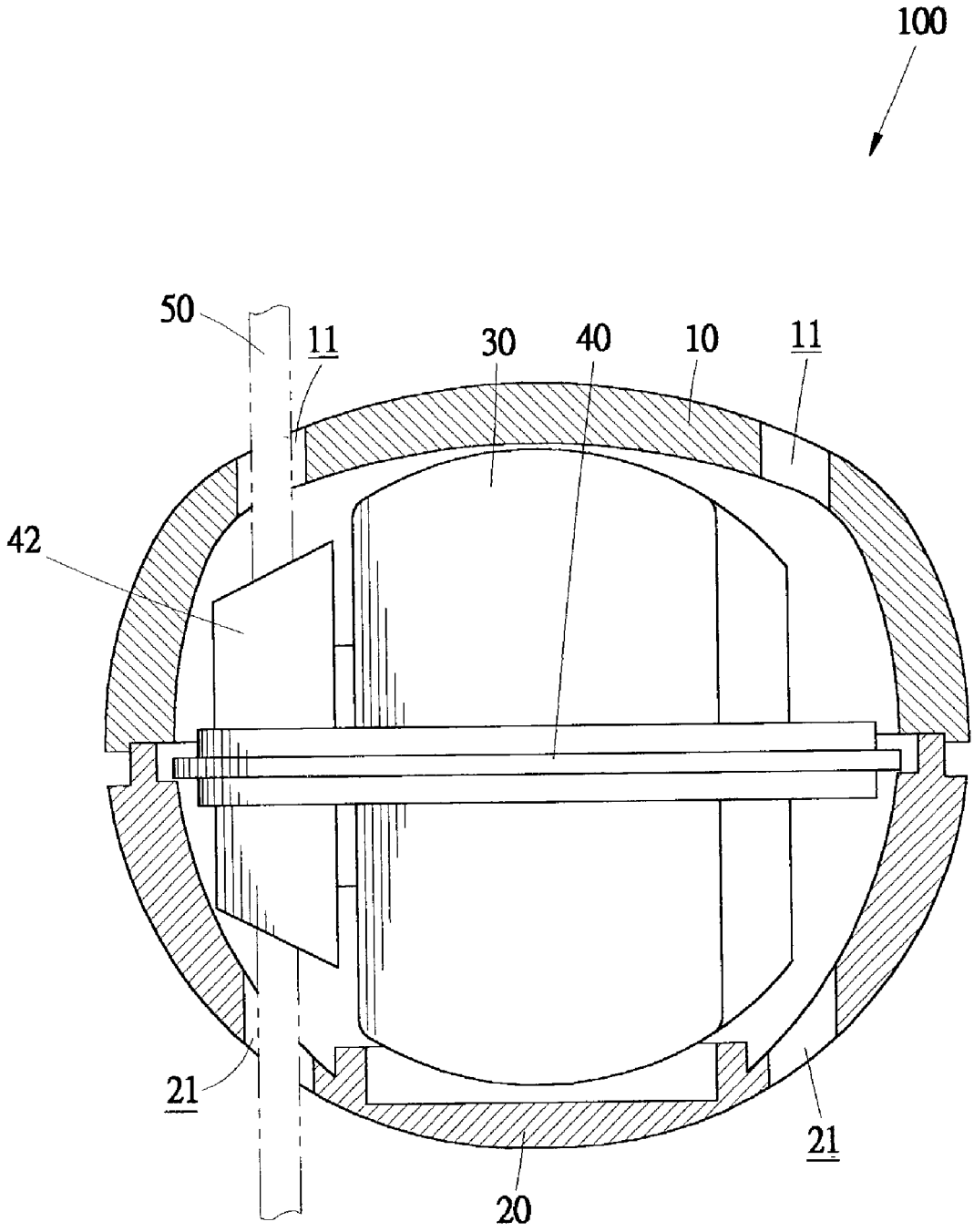
FIG. 4 is a cross-sectional view of the wrist exerciser of the present invention.

A drive bar 50 has a length sufficient to extend through the slots 11, 21 of the upper and lower casing members 10, 20 and the box 42 as particularly shown in FIG. 4. The drive bar 50 is drivingly engageable with the drive roller 33 whereby operating the drive bar 50 causes the roller 33 to drive an initial rotation of the rotor 30. In the embodiment illustrated in FIGS. 1–5, the roller 33 is a toothed wheel and corresponding thereto, the drive bar 50 comprises a rack 51 engageable with the toothed wheel 33. A pull ring 52 is formed on a remote end of the drive bar 50 for player's pulling the drive bar 50.

To operate, the drive bar 50 is put into the casing through the slots 11, 21 of the upper and lower casing members 10, 20 and extends through one of the passages 423 of the box 42 with the rack 51 engages the toothed wheel 33. Forcibly pulling the drive bar 50 out of the casing through the slots 11, 21 of the upper and lower casing members 10, 20, as indicated by arrow of FIG. 5, causes the drive roller 33 to drive the rotor 30 to rotate. Thus, an initial rotation of the rotor 30 with a high speed and great torque is realized. The slots 11, 21 are preferably arranged along a circular path to ensure that the box 42 can always be aligned with one of the slot pairs 11, 21 for next operation.

Figure 6:
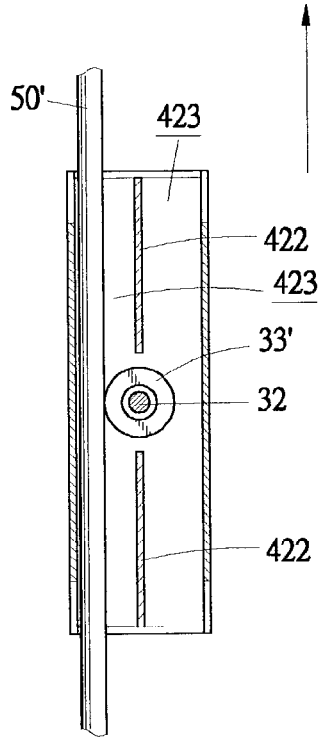
FIG. 6 is a cross-sectional view showing an actuating device of the wrist exerciser constructed in accordance with a second embodiment of the present invention.

With reference to FIG. 6, which shows a second embodiment of the wriest exerciser in accordance with the present invention. The second embodiment wrist exerciser is substantially the same as the first embodiment wrist exerciser. Thus, parts or members of the second embodiment wrist exerciser that are identical or similar to the parts or members of the first embodiment wrist exerciser bear the same reference numerals and will not be described again for simplicity. As shown in FIG. 6, the drive roller that is embodied as a toothed wheel 33 in the first embodiment is now embodied in the form of a friction roller in the second embodiment and is designated with reference numeral 33' for distinction. An example of the friction roller 33' is a rubber roller. Corresponding to the friction roller 33', the drive bar that is embodied in the form of a rack in the first embodiment is now replaced by a bar having a high friction surface and is designated with reference numeral 50'. An example of the friction bar 50' is a rubber bar or a bar having a rubber-made surface layer to form a frictional engagement with the friction roller 33'. Similar to the first embodiment, forcibly pulling the drive bar 50' as indicated by the arrow of FIG. 6 causes the roller 33' to drive the initial rotation of the rotor 30, by means of frictional engagement, rather than the toothed engagement in the first embodiment.

Figure 7:
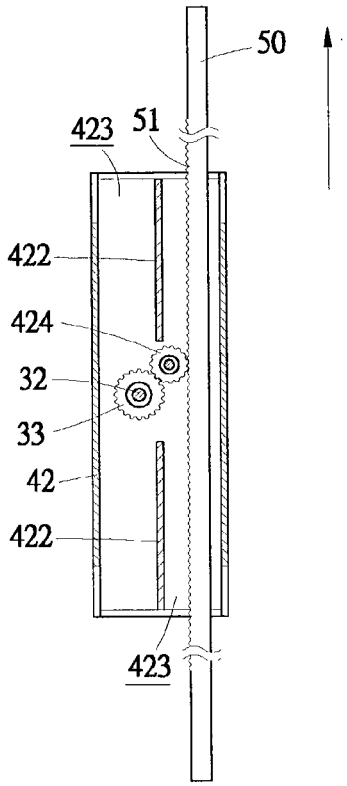
FIG. 7 is a cross-sectional view showing an actuating device of the wrist exerciser constructed in accordance with a third embodiment of the present invention.

With reference to FIG. 7, which shows a third embodiment of the wriest exerciser in accordance with the present invention. The third embodiment wrist exerciser is substantially the same as the first embodiment wrist exerciser. Thus, parts or members of the third embodiment wrist exerciser that are identical or similar to the parts or members of the first embodiment wrist exerciser bear the same reference numerals and will not be described again for simplicity. As shown in FIG. 7, an additional toothed wheel 424 is rotatably supported in the box 42 and arranged between the toothed wheel 33 and the rack 51 of the drive bar 50. Forcibly pulling the drive bar 50 as indicated by the arrow of FIG. 7 causes the additional toothed wheel 424 to rotate and the rotation is transmitted to the rotor 30 via the toothed wheel 33. Thus, pulling the drive bar 50 will eventually cause the roller 33 to drive the initial rotation of the rotor 30.

The arrangement of the additional toothed wheel 424 allows for different torque in causing the initial rotation of the rotor 30. This can be done by making use of additional toothed wheel 424 of different specification that provides different ratio of diameters between the toothed wheels 424, 33.

Figure 8:
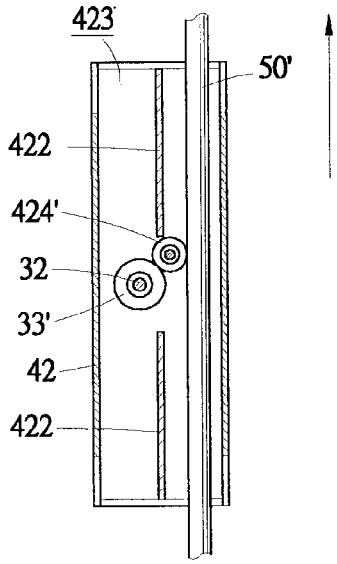
FIG. 8 is a cross-sectional view showing an actuating device of the wrist exerciser constructed in accordance with a fourth embodiment of the present invention.

With reference to FIG. 8, which shows a fourth embodiment of the wriest exerciser in accordance with the present invention. The fourth embodiment wrist exerciser is substantially the same as the second embodiment wrist exerciser. Thus, parts or members of the fourth embodiment wrist exerciser that are identical or similar to the parts or members of the second embodiment wrist exerciser bear the same reference numerals and will not be described again for simplification of the description. As shown in FIG. 8, an additional friction roller 424' is rotatably supported in the box 42 and arranged between the friction roller 33 and the friction layer of the drive bar 50'. Forcibly pulling the drive bar 50' as indicated by the arrow of FIG. 8 causes the additional friction roller 424' to rotate and the rotation is transmitted to the rotor 30 via the friction roller 33'. Thus, pulling the drive bar 50' will eventually cause the roller 33' to drive the initial rotation of the rotor 30.

Similar to the third embodiment, the arrangement of the additional friction roller 424' allows for different torque in causing the initial rotation of the rotor 30. This can be done by making use of additional friction roller 424' of different diameter that provides different ratio of diameters between the friction rollers 424', 33'.

Figure 9:
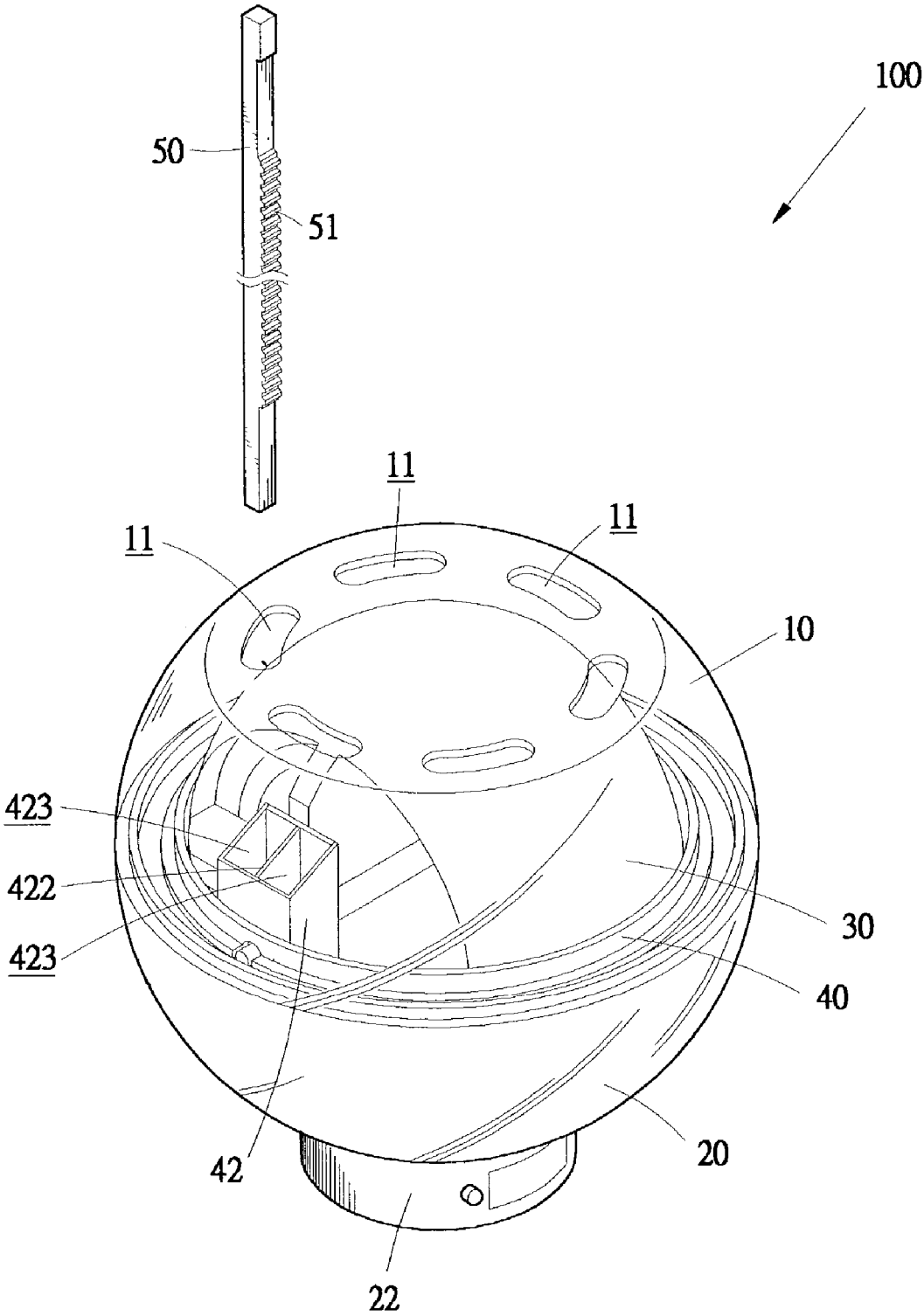
FIG. 9 is a perspective view of a wrist exerciser constructed in accordance with a fifth embodiment of the present invention.
Figure 10:
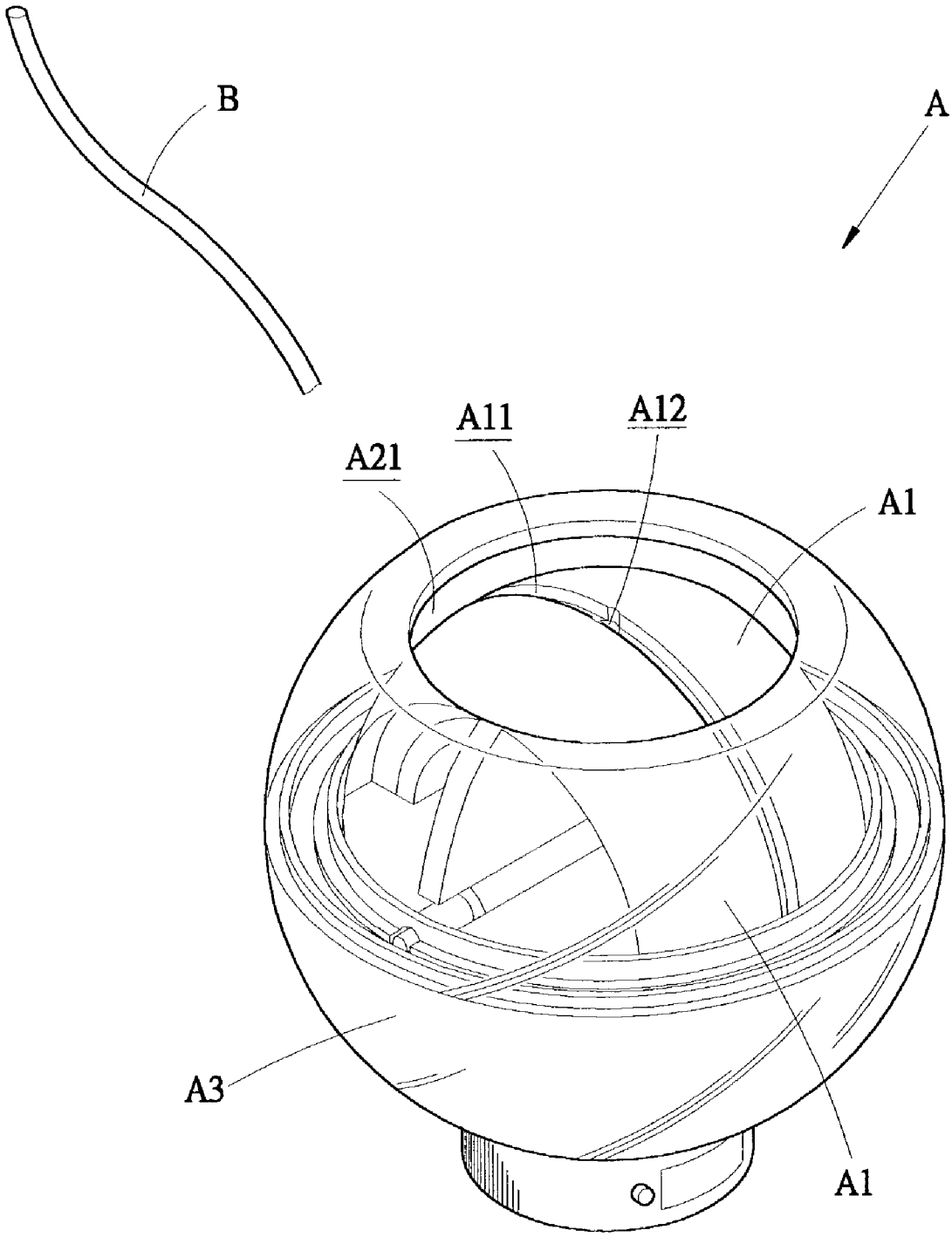
FIG. 10 is a perspective view of a conventional wrist exerciser.

FIG. 9 shows a wrist exerciser constructed in accordance with a fifth embodiment of the present invention. The fifth embodiment wrist exerciser is substantially the same as the first embodiment wrist exerciser. Thus, parts or members of the fifth embodiment wrist exerciser that are identical or similar to the parts or members of the first embodiment wrist exerciser bear the same reference numerals and will not be described again for simplicity. As shown in FIG. 9, a counter 22 is mounted to the lower casing member 20 of the casing of the wrist exerciser 100. The counter 22 provides counting for the turns of rotation of the rotor 30.

The wrist exercise 100 of the present invention, as illustratively described with embodiments shown in FIGS. 1–9, allows for initial actuation by a drive bar 50, 50' extending through small slots 11, 21 defined in the casing. Troublesome operation of winding a rope around the rotor is no longer required. Thus, failure of initial actuation by incorrect rope winding is eliminated. In addition, no large opening is needed. Thus, damage caused to the player's finger accidentally put into the casing through the opening is completely eliminated.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A wrist exerciser comprising:

a casing formed by an upper casing member coupled to a lower casing member for relative movement of one with respect to the other, each of the upper and lower casing members having a plurality of slotted openings formed therethrough in angularly spaced relationship, the plurality of slotted openings of the upper casing member being alignable with the plurality of slotted openings of the lower casing member;

a rotor received in the casing and encompassed thereby, the rotor having axially aligned rotation shafts respectively and rotatably received in holes defined in the casing for rotatably supporting the rotor inside the casing;

a drive roller fixedly mounted to one of the rotation shafts; and a drive bar partially and movably received in the casing through a respective one of the plurality of slotted openings of the upper and lower casing members, the drive bar having a portion drivingly engageable with the drive roller whereby by forcibly pulling the drive bar out of the casing, the roller is caused to drive an initial rotation of the rotor inside the casing.

2. The wrist exerciser as claimed in claim 1 further comprising a counter mounted to the casing for counting turns of rotation of the rotor.

3. The wrist exerciser as claimed in claim 1 further comprising light emitting elements mounted to the rotor.

4. The wrist exerciser as claimed in claim 1, wherein the drive roller comprises a toothed wheel and wherein the portion of the drive bar that drivingly engages the drive roller comprises a rack mateable with the toothed wheel.

5. The wrist exerciser as claimed in claim 1, wherein the drive roller comprises a friction roller and wherein the portion of the drive bar comprises a high friction surface frictionally engageable with the friction roller.

6. The wrist exerciser as claimed in claim 5, wherein the friction roller is made of rubber and wherein the high friction surface of the drive bar is made of a rubber layer.

7. The wrist exerciser as claimed in claim 1 further a box mounted inside the casing and housing the drive roller, partition means being formed inside the box to define two passages on opposite sides of the drive roller for the extension of the drive bar.

8. The wrist exerciser as claimed in claim 1, wherein the box has an inner wall defining an opening for accommodating the drive roller and the rotation shall of the rotor.

9. The wrist exerciser as claimed in claim 1, wherein the drive bar forms a pull ring on a remote end thereof.

* * * * *